US005197318A

United States Patent [19]

Joyce et al.

[11] Patent Number: 5,197,318

[45] Date of Patent: Mar. 30, 1993

[54] METAL FORMING METHOD AND APPARATUS

[75] Inventors: Roger L. Joyce, New Brighton; Ron Westby, Anoka, both of Minn.

[73] Assignee: Exaire Co., New Brighton, Minn.

[21] Appl. No.: 826,146

[22] Filed: Jan. 27, 1992

[51] Int. Cl.[5] ..... B21B 1/24; B30B 3/04

[52] U.S. Cl. ..... 72/187; 72/192; 100/153; 100/222; 226/171; 226/172; 425/371

[58] Field of Search ..... 72/48, 161, 170, 177, 72/187, 190, 192; 29/33 Q, 33 S, 521, 525, 890.046; 226/171, 172; 100/153, 207, 208, 222; 264/280, 287; 425/343, 345, 362, 369, 370, 371, 383, 396

[56] References Cited

U.S. PATENT DOCUMENTS

| | | | |
|---|---|---|---|
| 493,860 | 3/1893 | Fay . | |
| 767,883 | 8/1904 | Grafton . | |
| 1,212,482 | 1/1917 | Harrison | 72/190 |
| 1,293,072 | 2/1919 | Ford . | |
| 1,732,450 | 10/1929 | Vance . | |
| 2,071,584 | 2/1937 | Shippy . | |
| 2,219,805 | 10/1940 | Buttress | 425/370 |
| 2,785,717 | 3/1957 | Knowles . | |
| 3,137,337 | 6/1964 | Ungerer . | |
| 3,157,551 | 11/1964 | Granozio | 425/371 |
| 3,501,565 | 3/1970 | Kalwaites et al. . | |
| 3,621,524 | 11/1971 | Sherwood | 425/371 |
| 3,673,838 | 7/1972 | Clempson | 72/187 |
| 4,027,517 | 6/1977 | Bodnar | 72/177 |
| 4,604,792 | 8/1986 | Larson | 29/594 |
| 4,824,354 | 4/1989 | Keaton | 425/345 |

*Primary Examiner*—Lowell A. Larson
*Assistant Examiner*—Thomas C. Schoeffler
*Attorney, Agent, or Firm*—Haugen and Nikolai

[57] ABSTRACT

Apparatus for forming fins along a web of metallic material utilizing first and second opposed endless chains, and with the first chain adapted to support the web of metallic material thereon, and comprising a plurality of spaced-apart anvil links. The upper chain includes a plurality of spaced-apart links operating in registry with the base chain and including work-engaging, fin-forming lugs which enter the gap between mutually adjacent anvil links. The apparatus further includes a chain-deflecting idler roll which deflects the base chain arcuately away from its normal plane so as to effectively reduce the spacing between adjacent anvil links and create a web back-breaking zone for achieving a firm and solid crimping of that portion of the web forced thereinto by the fin-forming lugs.

6 Claims, 3 Drawing Sheets

METAL FORMING METHOD AND APPARATUS

BACKGROUND OF THE INVENTION

The present invention relates generally to an apparatus for formation of a plurality of generally regularly spaced-apart upstanding fins or ribs along a web of metallic material, and particularly for forming such fins or ribs on metallic material designed for use in heat transfer systems, with particular application to flat-plate heat transfer cells. The apparatus of the present invention is designed for substantially continuous operation, utilizing continuous motion of a supply web of metallic material, such as aluminum, for passage therethrough. The fins which are formed in the metallic material have been found to be tightly crimped web segments, and as such, have been found to enhance the heat transfer capability of assemblies formed therefrom.

In the past, various techniques have been designed for the formation or closing of the fins on metallic webs, and in the formation of such webs, gaps have been frequently found between the adjacent metallic layers forming the fins, with such gaps permitting air to become trapped therebetween, and thereby effectively diminishing the heat transfer capability of the fins and hence in systems created therefrom. Cross-contamination may also occur in some designs, particularly adjacent the edges or ends. The present arrangement has been found to create tightly formed fins which, when formed, create an integral upstanding smooth-surfaced web segments having outstanding heat transfer capability and mechanical properties, including rigidity and durability. Furthermore, the apparatus of the present invention has been found to effectively and economically form such fins from a web of metal (normally aluminum), with the fin forming motion being undertaken and accomplished on a substantially continuous basis.

SUMMARY OF THE INVENTION

The fin forming apparatus of the present invention comprises means for supporting first and second endless chains, each of which includes an operative flight, in generally opposed relationship one to the other. The opposed flights create a metallic material work zone disposed along a plane arranged generally midway between the opposed flights, and means are provided for continuously driving the endless chains along the predetermined paths. The first endless chain has a plurality of generally equally spaced-apart work supporting anvil links arranged therealong, and defining a plurality of work receiving and fin pre-form or crimp-forming zones therebetween. The second endless chain has a plurality of generally equally spaced-apart links having work-engaging fin-forming male lugs extending outwardly therefrom and arranged to enter the fin pre-form creating work zones to create fin pre-forms along the metallic web while passing through the work zone. A path-defining, chain-deflector idler roll is arranged along the path of the first endless chain and arcuately deflects the chain away from the plane of the work zone to effectively reduce the spacing between adjacent anvil links and create a web back-breaking zone along the endless chain to close the pre-forms and form rigid closed fin members. In order to create the back-breaking zone along the first endless chain, the idler roll is disposed closely adjacent to an opposed chain-supporting roll disposed to support the underside of the first endless chain. The first and second endless chains are further arranged to maintain the fin pre-forms within the work crimp zones until the first endless chain passes through the back-breaking zone thereby firmly crimping the fin pre-forms and creating mechanically sound thermally effective structures.

Therefore, it is a primary object of the present invention to provide an improved apparatus for creating a plurality of generally regularly spaced-apart upstanding fins along a web of metallic material, with the fins being tightly crimped together and thereby having improved thermal and mechanical properties.

It is a further object of the present invention to provide an improved apparatus for forming a plurality of generally regularly spaced-apart upstanding closed fins along a web of metallic material, and wherein a pair of opposed endless chains are utilized to crimp the web at spaced-apart locations so as to form firmly closed fins having good thermal and mechanical properties.

Yet a further object of the present invention is to provide an improved apparatus for the formation of a plurality of generally regularly spaced-apart upstanding fins along a web of metallic material wherein the web is treated on a substantially continuous basis by passing through a work zone created between a pair of opposed flights of first and second endless chains, the first chain having spaced-apart anvil elements extending outwardly therefrom, and with the second chain having fin forming lugs extending generally outwardly therefrom toward the first chain so as to enter the gap so as to engage the zones between mutually adjacent anvil links.

Other and further objects of the present invention will become apparent to those skilled in the art upon a study of the following specification, appended claims, and accompanying drawings.

IN THE DRAWINGS

Figure 3:
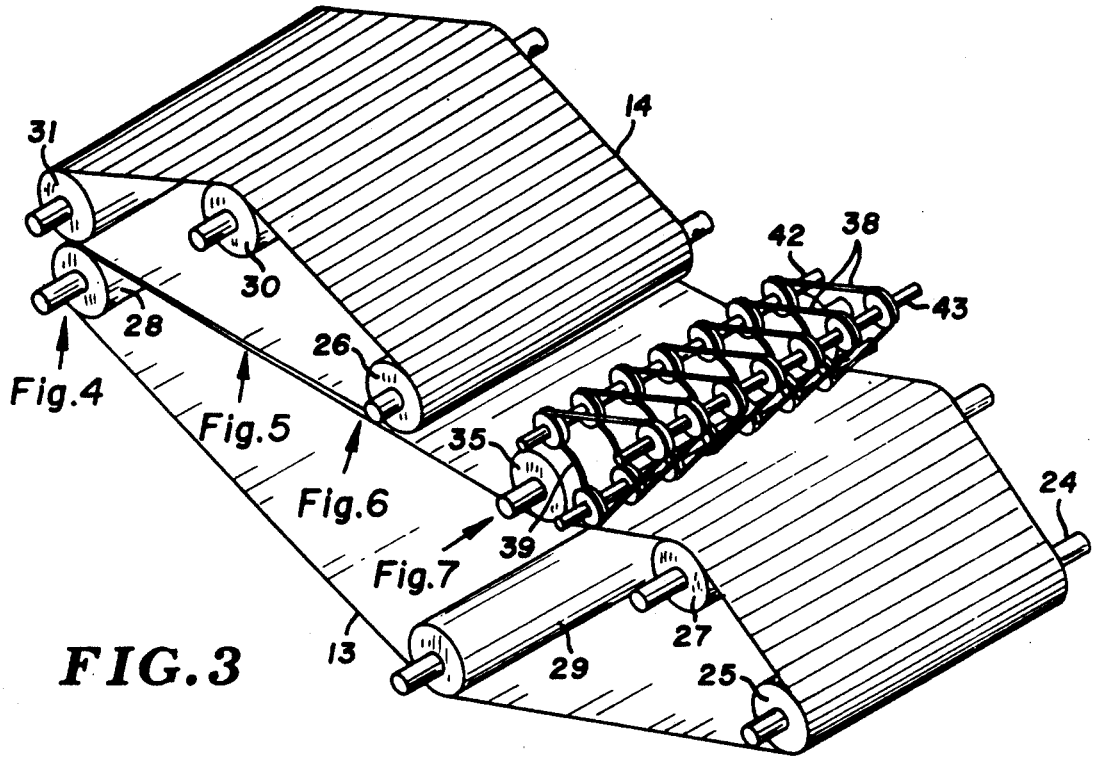
FIG. 3 is a view of the apparatus taken generally along the line and in the direction of the arrows 3—3 of FIG. 2, and illustrating the general arrangement of the endless chains and support rollers therefor, and otherwise illustrating the apparatus with the frame means removed.
Figure 6:
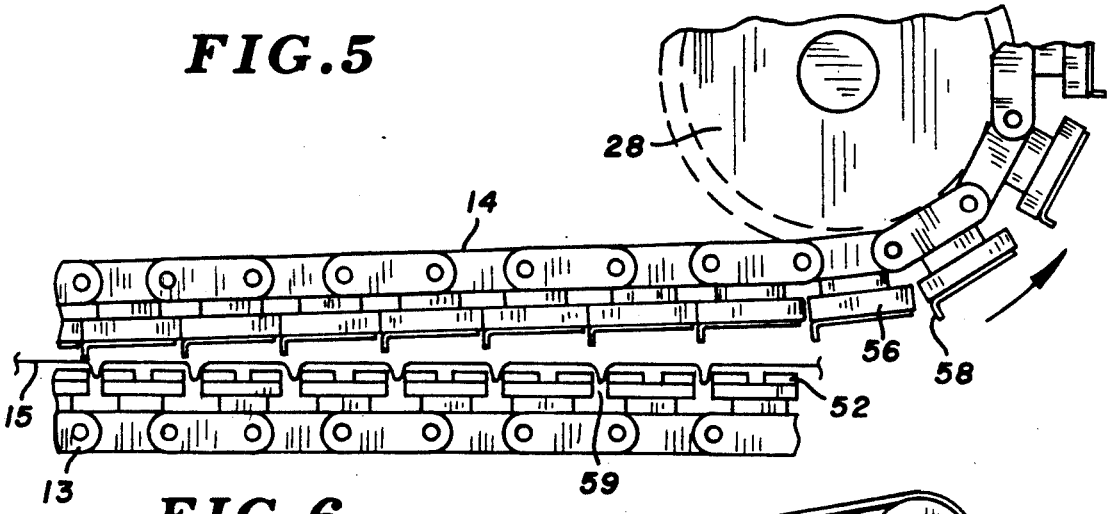
Figure 7:
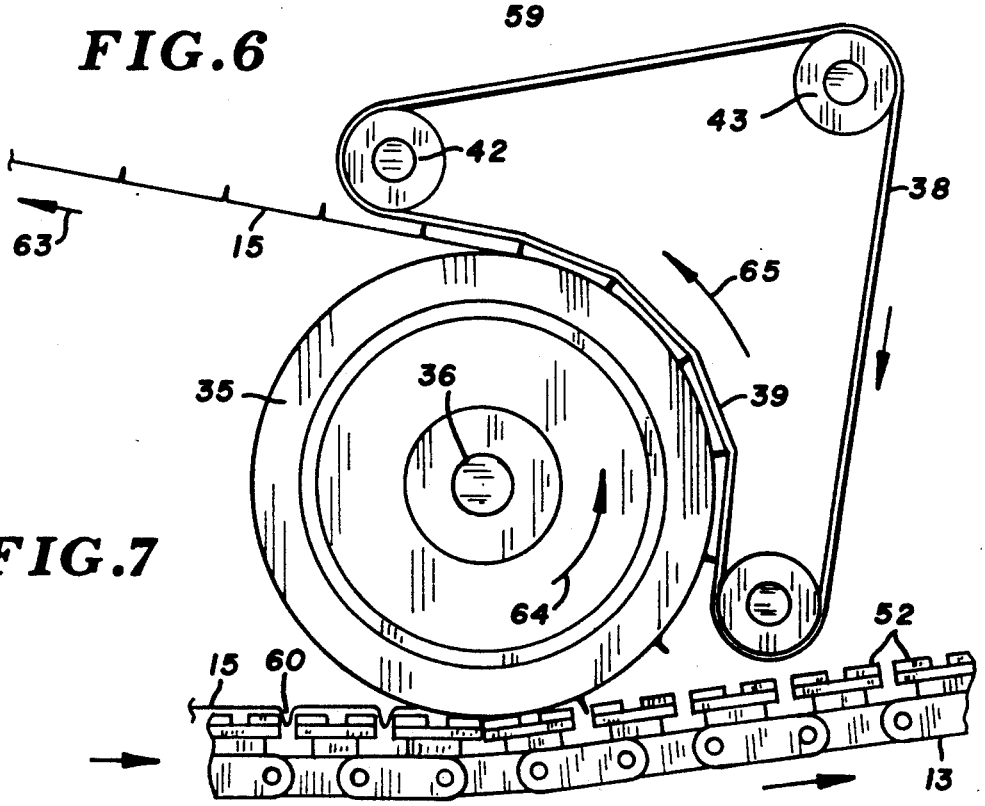

FIG. 6 is a view of that portion of the apparatus shown at "FIG. 6" of FIG. 3, and illustrating that portion of the apparatus adjacent the end of the work station formed between the opposed endless chains; and FIG. 7 is a view of that portion of the apparatus shown at "FIG. 7" of FIG. 3, and illustrating the detail of the back-breaking or fin-closing station in the apparatus, and also illustrating the manner in which a web take-up means is utilized to remove the finished fin containing web from the apparatus.

DESCRIPTION OF THE PREFERRED EMBODIMENT

Figure 1:
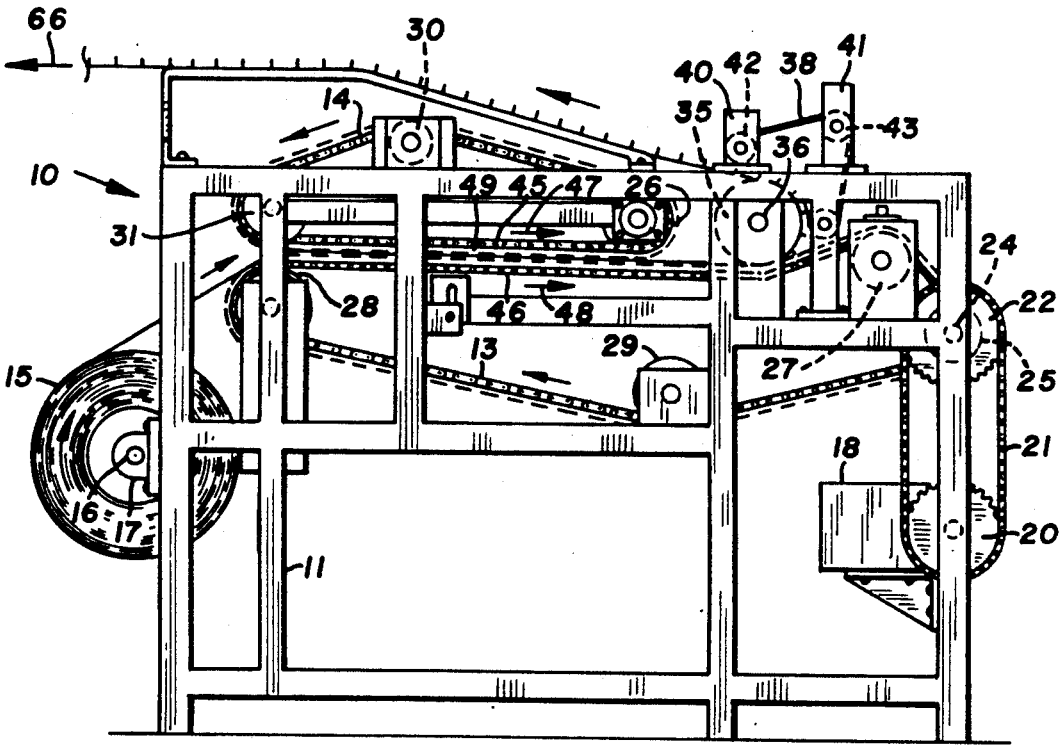
FIG. 1 is a side elevational view of a fin-forming apparatus in accordance with the present invention.
Figure 2:
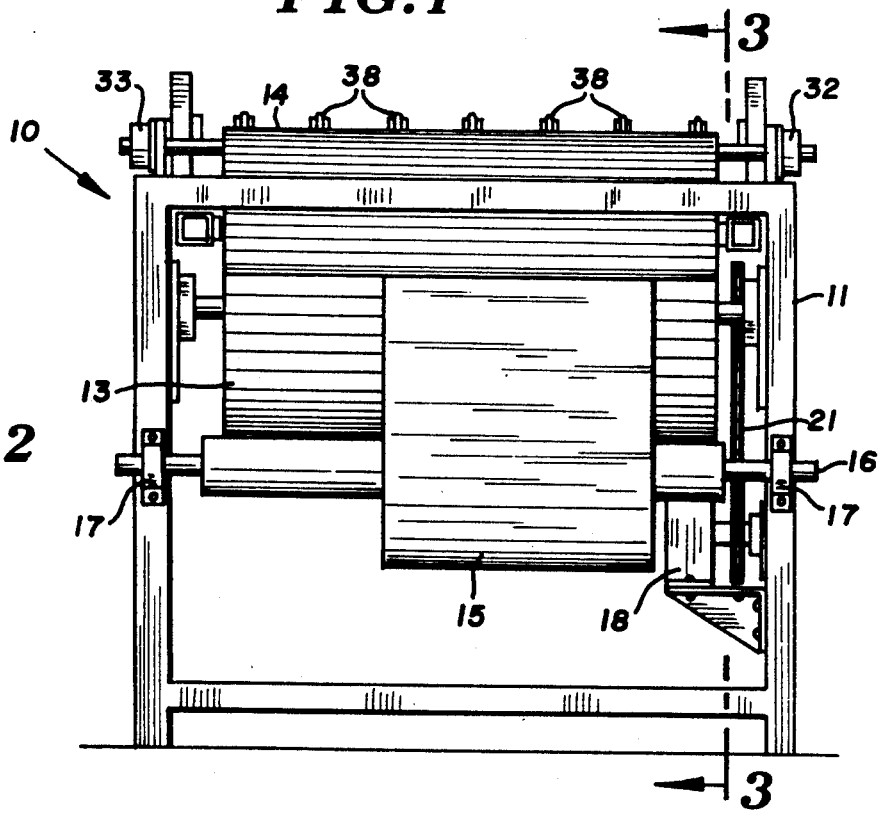
FIG. 2 is an end elevational view taken at the infeed end of the apparatus shown in FIG. 1.

Attention is now directed to FIGS. 1 and 2 of the drawings, wherein the web treating apparatus generally designated 10 includes frame means 11 supporting a pair of endless chains 13 and 14 in operative relationship thereon. A web of metallic material 15 is mounted on frame 11, as illustrated, with web 15 being supported by shaft 16 in a pair of opposed bearing members 17—17. A drive motor 18 is provided for rotational motion of drive sprocket 20, with sprocket 20 on motor 18 providing continuous motion to drive chain 21. Drive chain 21 is in mesh with driven sprocket 22, with sprocket 22 being fast on shaft 24, thereby providing drive motion to chain 13 through conveyor chain drive cylinder 25. A number of drive and idler cylinders are provided along the path of endless chain 13, with idlers being shown at 27 and 29, and with an additional main guide or idler cylinder being shown at 28. Chain 14 is driven by means of an interconnecting drive chain (not shown) which receives rotational motion from driven sprocket 22 and provides rotational motion or drive energy to chain support and drive roll or cylinder 26. Chain 14 is further supported along its path by additional support cylinders as at 30 and 31. As is conventional, each of the drive cylinders and idler cylinders are rotatably journaled for rotation on frame 11 by conventional bearing means, such as, for example, as illustrated at 32 and 33 (FIG. 2). Such apparatus, it will be appreciated, is standard in the art and is well known and within the knowledge of skilled artisans.

With further attention being directed to FIG. 1 of the drawings, idler roll 35 is provided adjacent endless chain 13, and is designed to provide a path-defining, chain deflecting force to chain 13. Idler 35 is journaled appropriately on shaft 36, as indicated in FIG. 1. An attachment is provided to idler 35 in the form of take-up means, including spaced-apart belts 38—38, operatively arranged to move along a portion of the outer surface of idler roller 35, such as illustrated at 39 (FIG. 3). Suitable support brackets are disposed as at 40 and 41 for appropriately retaining shafts 42 and 43 journably supported and defining the operative paths of belts 38—38.

With continuing attention being directed to FIG. 1, endless chains 13 and 14 include operative flights as at 45 and 46, and move in the direction of arrows 47 and 48. The position of the flights 45 and 46 is such that a metallic material work zone 49 is created along a plane arranged midway between flights 45 and 46. As is apparent from the views of FIGS. 1, 3 and 7, idler 35 is disposed relatively closely adjacent chain support cylinder 27, thereby providing an arcuate chain deflecting path to deflect the path of chain 46 arcuately away from the plane of the work zone 49. This deflection effectively creates a back-breaking zone for work moving through work zone 49, as will be more fully described hereinafter.

Figure 4:
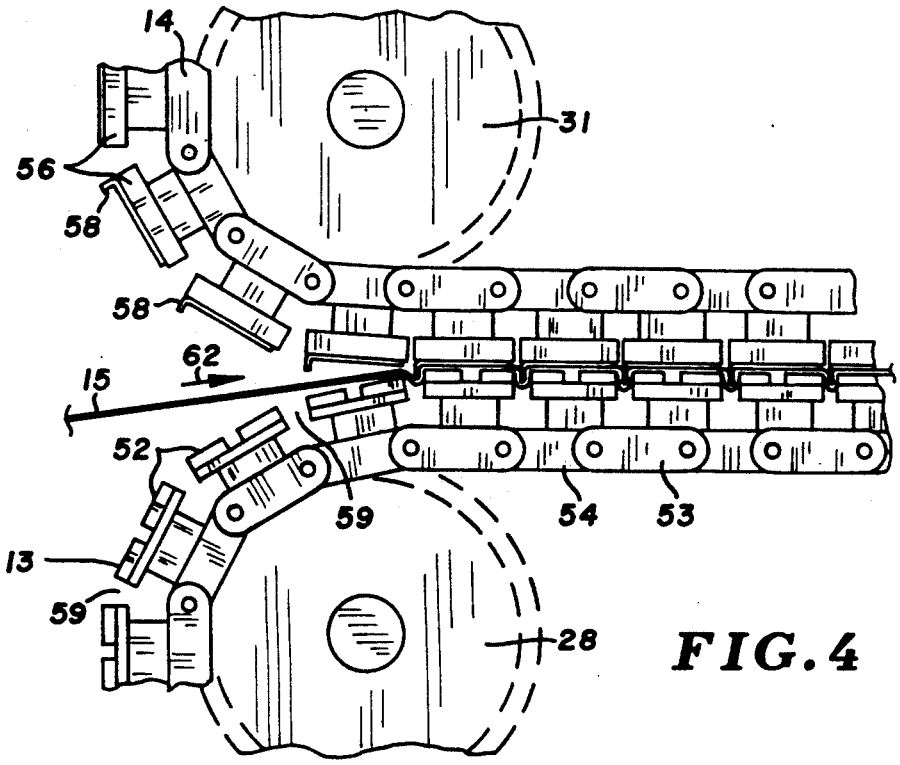
FIG. 4 is a detail sectional view, partially broken away, of the that portion of the apparatus shown at "FIG. 4" of FIG. 3, and illustrating the detail of the device in fragmentary form, and being shown on a slightly enlarged scale.

With attention now being directed to FIG. 4 of the drawings, endless chain 13 comprises a plurality of generally equally spaced-apart work supporting anvil links 52—52. Links 52 are, in turn, supported directly on chain links as at 53 and 54 respectively. Chain links 53 and 54 are conventional in the art, and means are well known for attaching members such as anvil links 52 thereto. Chain 14, in turn, is provided with a plurality of generally equally spaced-apart links as at 56—56, with links 56—56 having work-engaging fin-forming lugs 58—58 coupled thereto and extending outwardly therefrom. Work-engaging fin-forming lugs 58—58 are arranged to enter the work crimping zones 59—59 created in the gap or spacing between individual links of endless chain 13. These work crimping zones 59—59 create fin pre-forms along the metallic web while passing through the work zone and upon engagement with lugs 58—58 from endless chain 14.

Endless chains 13 and 14 are arranged to maintain the fin pre-forms within the gap defining the work crimp zones 59—59 until the web has advanced through the back-breaking zone, it being recalled that the pre-forms are more firmly engaged and thereby are formed into integral fins with good thermal and mechanical properties.

Figure 5:
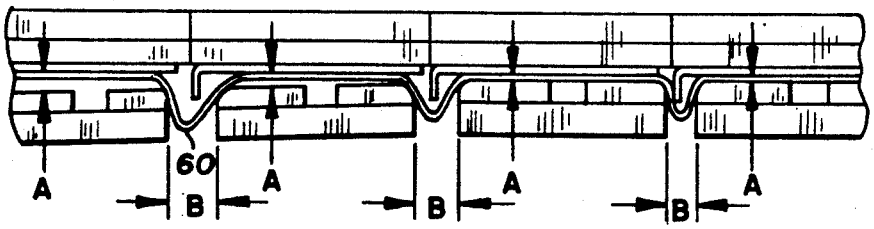
FIG. 5 is a view similar to FIG. 4 and taken along that portion of the apparatus shown at "FIG. 5" of FIG. 3, and illustrating the detail of the cooperating links of the opposed endless chains.

Upon passing through the work zone 49, fin pre-forms as shown at 60 are initially formed, with the motion of the endless chains 13 and 14 providing a modest reduction in the dimensional gaps existing between mutually adjacent anvil links 52—52. This dimensional gap is illustrated at "B" in FIG. 5, with the individual fin pre-forms 60 being more deeply seated within the gap or crimp zones 59—59 due to a progressive narrowing of the gap taken together with the reduction in the spaced-apart relationship of endless chains 13 and 14 as demonstrated by "A" in FIG. 5 as the web moves progressively through the work zone. This is due in part to the arrangement of the flights 45 and 46, it being noted that the flights diverge as they pass along the work zone to permit the fin-forming lugs 58—58 to withdraw from the work crimp zones. This gap progressively increases after the fin pre-forms are formed, particularly as illustrated in FIG. 6.

The detail of the back-breaking zone is illustrated at FIG. 7, with the back-breaking zone including the application of force by idler 35 against the surface of endless chain 14, thereby significantly reducing the gap existing between mutually adjacent anvil links 52—52, and effectively tightly crimping the fin pre-forms while a flattening pressure is applied to the overall web of metallic material 15. As is indicated in FIGS. 4 and 7, web 15 moves along its path in the direction of arrows 62 (FIG. 4) and 63 (FIG. 7). Round plastic belts such as at 38—38 are designed to hold the finished web or panel tightly against the surface of rubber-covered idler roller 35. Idler 35 rotates along the direction of arrow 64 in FIG. 7. This provides a cooperative and equal linear motion with round plastic belts 38—38, which move along the line of arrow 65 as illustrated in FIG. 7. Essentially, the idler roll 35 applies sufficient force against the surface of the endless chain 13 so as to cause a portion of the flight to assume a configuration which is tangent to the surfaces of idler 35 and cylindrical idler roll 27.

As is indicated by arrow 66 (FIG. 1), web 15, when finished, moves outwardly of the apparatus 10 along and in the direction of arrow 66 for ultimate collection or severing. At this point, the substantially continuous web 15 is severed into individual web segments, with each having a length appropriate for the application required. Various shear die mechanisms, all of which are well known in the art, may be utilized for this severing operation.

For certain applications, it may also be helpful to orient the arcuate path of the finished web in a direction such that the individual webs or ribs are actually tightened or urged more closely together during the creation of this initial arc. Thus, it may be helpful in certain applications to invert the position or relative dispositions of the chains so that the chain containing the anvil links is superimposed over the chain containing the fin-forming lugs.

It will be appreciated that those skilled in the art may depart from the detail of the apparatus illustrated herein without actually departing from the spirit and scope of the present invention.

What is claimed is:

1. Apparatus for the formation of a plurality of generally regularly spaced-apart upstanding fins along a web of metallic material, said apparatus comprising:

(a) frame means, first and second endless chains operatively coupled to said frame means with each of said endless chains including operative flights arranged in generally opposed disposition and creating a metallic material work zone along a plane arranged midway between said operative flights, means for continuously driving said endless chains each along a predetermined path;

(b) said first endless chain having a plurality of generally equally spaced-apart work supporting anvil links arranged in operative relationship with said second endless chain;

(c) said second endless chain having a plurality of generally spaced-apart links having work-engaging fin-forming lugs extending outwardly therefrom and arranged to enter spaces between adjacent anvil links to create fin pre-forms along said metallic web while passing through said work zone;

(d) a path-defining chain-deflecting idler roll operatively coupled to said frame means and arranged to deflect said first endless chain arcuately away from the plane of said work zone to effectively reduce the spacing between adjacent anvil links and to create a web back-breaking zone along said first endless chain; and (e) said first and second endless chains being arranged to maintain said pre-forms within the spaces between adjacent anvil links until said first endless chain passes through said back-breaking zone for firmly crimping said fin pre-forms.

2. The apparatus as defined in claim 1 being particularly characterized in that said idler roll includes web take-up means defining a path of travel for the metallic material web.

3. The apparatus as defined in claim 1 being particularly characterized in that said idler roll is comprised of a resilient material for applying a working force against the metallic material web and said first endless chain.

4. The apparatus as defined in claim 1 being particularly characterized in that said fin-forming lugs enter the spaces between adjacent anvil links.

5. The apparatus as defined in claim 1 being particularly characterized in that opposed flights of said first and second endless chains diverge as they pass along said metallic material work zone to permit said fin-forming lugs to withdraw from the spaces between adjacent anvil links prior to contact with said path-defining, chain-deflecting idler roll.

6. The apparatus as defined in claim 1 being particularly characterized in that means for receiving a supply roll of metallic material are coupled to said frame means and disposed for delivery of a web of metallic material into said work zone.

* * * * *